US008934654B2

(12) United States Patent
Fullam

(10) Patent No.: US 8,934,654 B2
(45) Date of Patent: Jan. 13, 2015

(54) NON-OCCLUDED PERSONAL AUDIO AND COMMUNICATION SYSTEM

(71) Applicant: Scott Fullam, Palo Alto, CA (US)

(72) Inventor: Scott Fullam, Palo Alto, CA (US)

(73) Assignee: AliphCom, San Francisco, CA (US)

( * ) Notice: Subject to any disclaimer, the term of this patent is extended or adjusted under 35 U.S.C. 154(b) by 0 days.

(21) Appl. No.: 13/802,266

(22) Filed: Mar. 13, 2013

(65) Prior Publication Data

US 2014/0270321 A1 Sep. 18, 2014

(51) Int. Cl.
*H04R 25/00* (2006.01)

(52) U.S. Cl.
USPC ..... 381/381; 381/387; 381/388

(58) Field of Classification Search
USPC ..... 381/330–331, 309, 311, 333–335, 381, 381/387–388
See application file for complete search history.

(56) References Cited

U.S. PATENT DOCUMENTS

| | | | | |
|---|---|---|---|---|
| 3,290,450 | A * | 12/1966 | Majoros | 381/182 |
| 4,070,553 | A * | 1/1978 | Hass | 381/301 |
| 4,084,139 | A * | 4/1978 | Jakobe | 381/301 |
| 4,539,700 | A * | 9/1985 | Sato | 381/333 |
| 5,212,734 | A * | 5/1993 | Tsao | 381/388 |
| 7,215,788 | B2 | 5/2007 | Hooley | |
| 7,515,719 | B2 | 4/2009 | Hooley et al. | |
| 7,577,260 | B1 | 8/2009 | Hooley et al. | |
| 2006/0204022 | A1 | 9/2006 | Hooley et al. | |
| 2008/0159571 | A1 | 7/2008 | Hooley | |
| 2009/0161880 | A1 | 6/2009 | Hooley et al. | |
| 2011/0222701 | A1 | 9/2011 | Donaldson et al. | |

FOREIGN PATENT DOCUMENTS

WO 2005086526 A1 9/2005

* cited by examiner

*Primary Examiner* — Suhan Ni
(74) *Attorney, Agent, or Firm* — Kokka & Backus, PC

(57) ABSTRACT

Embodiments relate generally to electrical and electronic hardware, computer software, wired and wireless network communications, and wearable computing devices, audio devices, and communication devices for facilitating the presentation of personal audio. More specifically, disclosed are an apparatus and method to form directional audio personal to a user in a non-occluded manner. In one embodiment, a personal audio and communication devices can include a first directional speaker disposed at a first mounting region of a first support member. The first support member is configured to position the first directional speaker adjacent a first ear in substantial alignment with the first ear. Also included is a second directional speaker disposed at a second mounting region of a second support member. The second support member is configured to position the second directional speaker adjacent a second ear in substantial alignment with the second ear.

3 Claims, 9 Drawing Sheets

NON-OCCLUDED PERSONAL AUDIO AND COMMUNICATION SYSTEM

FIELD

Embodiments relate generally to electrical and electronic hardware, computer software, wired and wireless network communications, and wearable computing devices, audio devices, and communication devices for facilitating the presentation of personal audio. More specifically, disclosed are an apparatus and method to form directional audio personal to a user in a non-occluded manner.

BACKGROUND

Conventional devices and techniques to produce a personal audio experience, whereby the audio is presented personally to the user only. Such devices and techniques generally require a user to employ headsets, headphones, ear plugs, or any other devices that cover the user's ears. In many situations, the user is interested in receiving audio personally to only the listener and is either does not want to disturb others in the listening vicinity or would rather keep the audio private.

Drawbacks to conventional personal audio systems include a deprivation of senses they can cause the listener to experience a diminished situational awareness. For example, the user using a headset or earphones will have one or both ears occluded from other audio, such as speech, of a person wishes to interact with the listener. Such conventional personal audio systems are not well-suited for a listener to carry on a conversation while receiving the personal audio.

Thus, what is needed is a solution for data capture devices, such as for wearable devices, without the limitations of conventional techniques.

BRIEF DESCRIPTION OF THE DRAWINGS

Various embodiments or examples ("examples") of the invention are disclosed in the following detailed description and the accompanying drawings.

DETAILED DESCRIPTION

Various embodiments or examples may be implemented in numerous ways, including as a system, a process, an apparatus, a user interface, or a series of program instructions on a computer readable medium such as a computer readable storage medium or a computer network where the program instructions are sent over optical, electronic, or wireless communication links. In general, operations of disclosed processes may be performed in an arbitrary order, unless otherwise provided in the claims.

A detailed description of one or more examples is provided below along with accompanying figures. The detailed description is provided in connection with such examples, but is not limited to any particular example. The scope is limited only by the claims and numerous alternatives, modifications, and equivalents are encompassed. Numerous specific details are set forth in the following description in order to provide a thorough understanding. These details are provided for the purpose of example and the described techniques may be practiced according to the claims without some or all of these specific details. For clarity, technical material that is known in the technical fields related to the examples has not been described in detail to avoid unnecessarily obscuring the description.

Figure 1A:
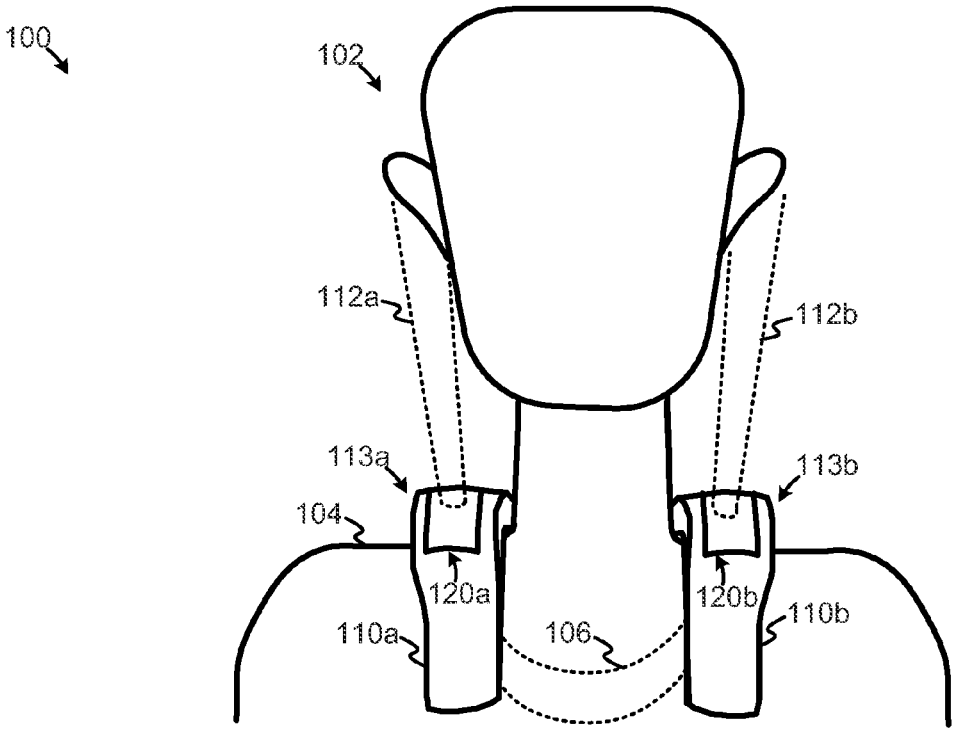
FIG. 1A is a diagram depicting a front view of a personal audio and communication device, according to some embodiments.

FIG. 1A is a diagram depicting a front view of a personal audio and communication device, according to some embodiments. Diagram 100 depicts personal audio and communication device including a first support member 113*a* and a second support member 113*b*, one or more of which are disposed at or on a shoulder region 104 of a user 102. First support member 113*a* includes a first audio source 120*a*, and a second support member 113*b* includes a second audio source 120*b*. First audio source 120*a* includes a first directional speaker disposed in a first mounting region of first support member 113*a*, whereas second audio source 120*b* includes a second directional speaker disposed in a second mounting region of second support member 113*b*. The first directional speaker of first audio source 120*a* is configured to generate a directional sound beam 112*a* directed to an ear and the second directional speaker of the second audio source 120*b* is configured to generate a directional sound beam 112*b* to another ear. In some embodiments the personal audio and communication device of diagram 100 can include a wireless communication module (not shown) configured to communicate audio wirelessly at least two the first and/or the second audio sources 120*a* and 120*b*. In some embodiments, first support member 113*a* is coupled via coupling member 106, which is optional, to the second support member 113*b*. The personal and audio communication system of various embodiments enable user 102 enables personal listening experiences (e.g., user 102 receives only the audio in a non-occluded manner), whether the audio is uni-directional (e.g., user 102 is listening to music) or bi-directional (e.g., user 102 is receiving audio and transmitting audio (via a microphone in the personal audio and communication device) in a telephone call or a gaming environment).

Figure 1B:
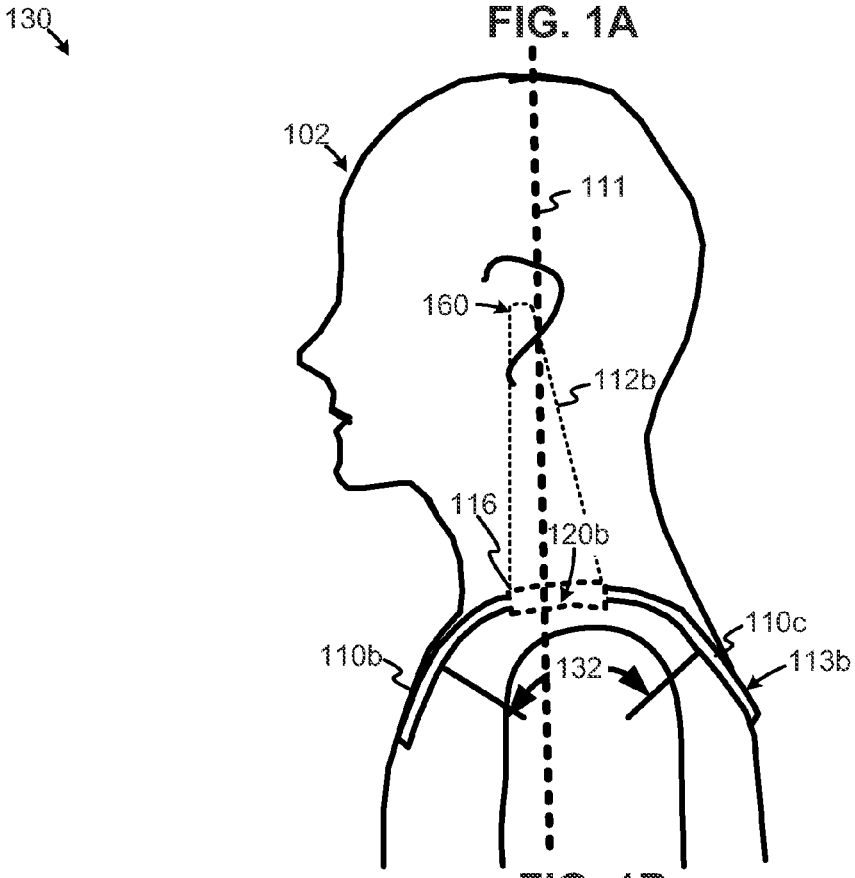
FIG. 1B is a diagram depicting a side view of a personal audio and communication device, according to some embodiments.

FIG. 1B is a diagram depicting a side view of a personal audio and communication device, according to some embodiments. Diagram 130 depicts a personal audio communication device including second support member 113*b*. Each support member includes a posterior support portion and an anterior support portion. As shown, second audio source 120*b* is disposed at a mounting region 116. Second audio source 120*b* is configured to generate a directional sound beam configured to propagate toward ear canal 160. In this example, posterior support portion 110*b* is coupled via mounting region 116 to anterior support portion 110*c*. In some examples, posterior support portion 110*b* has the same or substantially the same mass as anterior support portion 110*c*. Further, mounting region 116 can be disposed in or approximately in a frontal plane 111 that passes through user 102 from the head to the feet, thereby separating user 102 into an anterior portion and a posterior portion. According to some embodiments, mounting region 160 can be disposed adjacent to the shoulder of user 102 and parallel to any surface in the sector defined by angle 132.

Figure 1C:
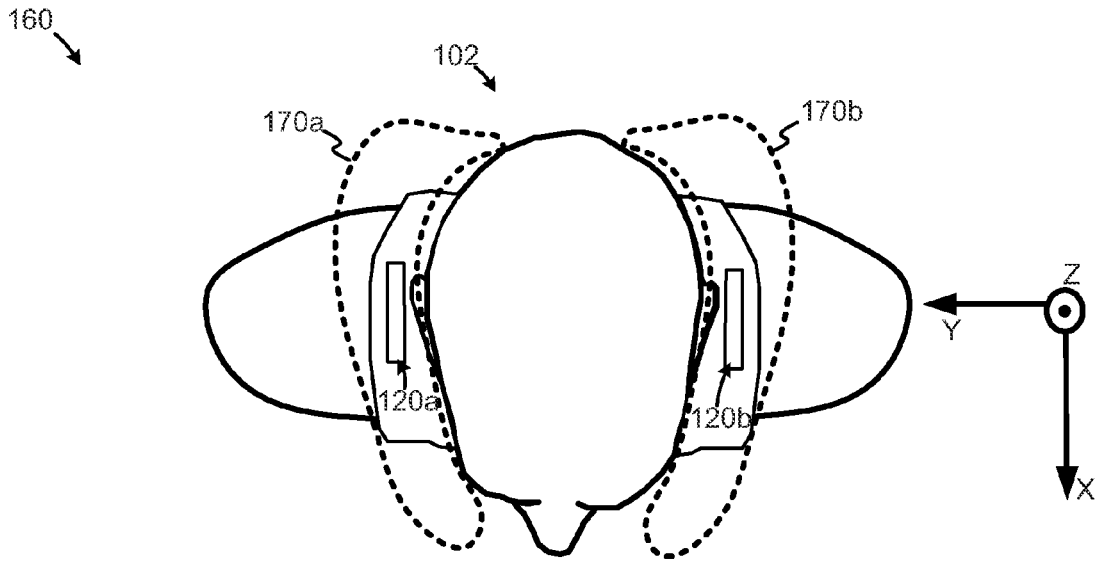
FIG. 1C is a diagram depicting a top view of a personal audio system community and communication device, according to some embodiments.

FIG. 1C is a diagram depicting a top view of a personal audio system community and communication device, according to some embodiments. As shown, audio source of 120*a* and audio source 120*b* are shown to be disposed at or near the top of the shoulders of user 102. Audio sources 120*a* and 120*b* configured to generate sound beams in regions 170*a* and 170*b*, respectively. Regions 170*a* and 170*b* are regions of audio in space that are audible to user 102 only as these regions are formed directionally to enclose a limited amount of space to isolate the audio to the user. These regions are shaped to enable each ear to perceive audio as the head of user 102 turns or rotate about the Z-axis. In some embodiments, regions 170*a* and 170*b* are centered on or about a corresponding ear and can be sized to about six inches from the ear canals or less.

In view of the foregoing, the personal audio and communication system of various embodiments is configured to provide personal audio to user 102 without disturbing other people nearby. Further, such personal audio is provided to user 102 in a non-occluded manner. As such, user 102 can have relatively increased amounts of situational awareness that otherwise might be the case. The personal and audio communication system of various embodiments enables user 102 to hear natural sounds about them without being blocked or otherwise occluded. As such, user 102 can carry on a conversation in normal volumes of speech with another person while still being able to listen to audio generated by the audio sources. By distributing the weight or mass of the personal audio and communication system equally or substantially equally over the posterior support member and the anterior support member, the personal audio communication system is balanced and about the top of the shoulders of user 102, such as in the frontal plane. By balancing the weight or mass of the personal audio and communication system at the top of the shoulders of user 102, the personal audio and communication system is relatively immobile and does not readily slip or fall off. Furthermore, one or more ports on the bottom of audio sources 102*a* and 102*b* are configured to direct low frequency audio into the tissues of user 102 at or near the shoulders, including muscle and bone among other types tissue. Directing low frequency audio into the body of user 102 provides for an enhanced listening experience.

Figure 2:
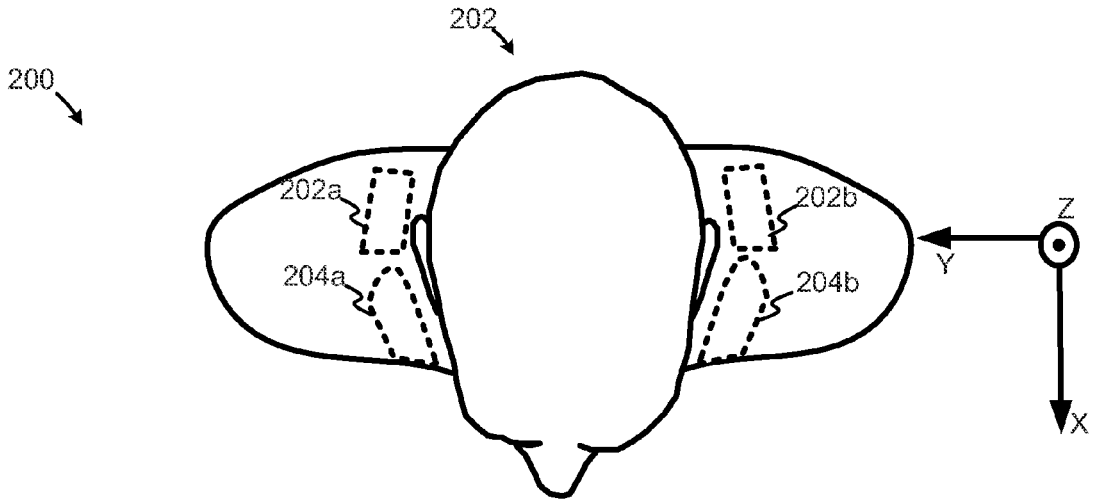
FIG. 2 is a diagram depicting a top view of a user including shoulder portions or regions into which low frequency audio can be directed, according to some embodiments.

FIG. 2 is a diagram depicting a top view of a user including shoulder portions or regions into which low frequency audio can be directed, according to some embodiments. Diagram 200 includes a user 202 in which regions 204*a* and 204*b* represent tissues that predominantly include bone (e.g., collarbone), whereas regions 202*a* and 202*b* represent tissues that predominantly include muscle. According to various embodiments, audio sources can include structures that direct one or more low frequency signals into the body of user 202 at the regions depicted in FIG. 2.

Figure 3:
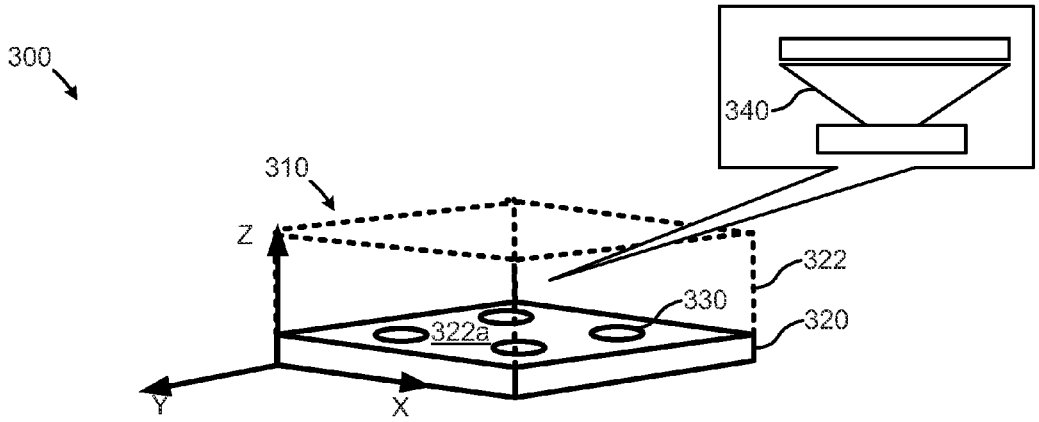
FIG. 3 is a diagram depicting a perspective top view of an audio source, according to some embodiments.

FIG. 3 is a diagram depicting a perspective top view of an audio source, according to some embodiments. Diagram 300 includes an audio source 310, which can include a directional speaker 340. Directional speaker 340 is shown to be disposed in a cavity 322, and is configured to generate directional audio at an ear or in a direction to an ear. Directional speaker 340 is configured to be in alignment or in substantial alignment to an ear (e.g., substantial alignment includes any direction that is 90 degrees or less that originates from a line extending from the output of directional speaker 340 to an ear, such as 45 degrees or less). Audio source 310 includes a bottom 320, which includes one or more ports 330. At least one port 330 is configured to direct low frequency audio and/or acoustic energy from audio source 310 to the tissue of a user. In particular, top surface 322*a* is shown to include ports 330. In some cases, acoustic energy originating from cavity 322 is transmitted via ports 330 out through the bottom of audio source 310. In some examples, low frequencies include frequencies from 10 to 200 Hz. Other frequencies ranges are also possible. In some embodiments, one or more ports 330 are configured to direct low frequency audio and/or acoustic energy from audio source 310 in a direction substantially opposite than the directions of directional speaker 340 (e.g., substantially opposite directions include directions separated by more than 90 degrees, such as 150 to 180 degrees).

Figure 4:
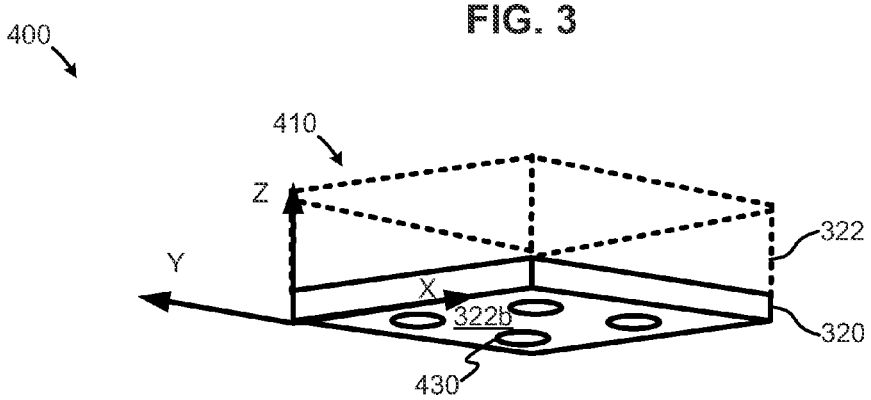
FIG. 4 is a diagram depicting a perspective bottom view of an audio source, according to some embodiments.

FIG. 4 is a diagram depicting a perspective bottom view of an audio source, according to some embodiments. Diagram 400 includes an audio source 410, which can include a directional speaker, such as shown in FIG. 3. As shown, bottom 320 of audio source 410 includes a bottom surface 322*b* which has one or more ports 430. In some embodiments, ports 430 are configured to direct low frequency audio in a direction into a tissue, whereby the direction is opposite in the direction of audio that is generated by directional speaker 340.

Figure 5:
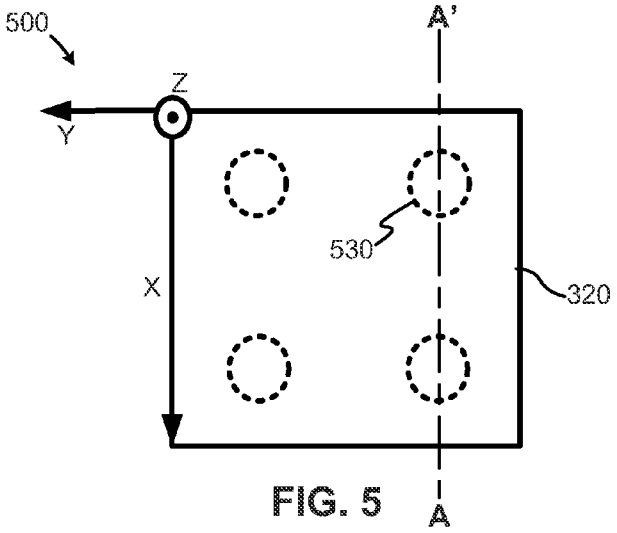
FIG. 5 is a top view of a bottom of an audio source, according to various embodiments.
Figure 6:
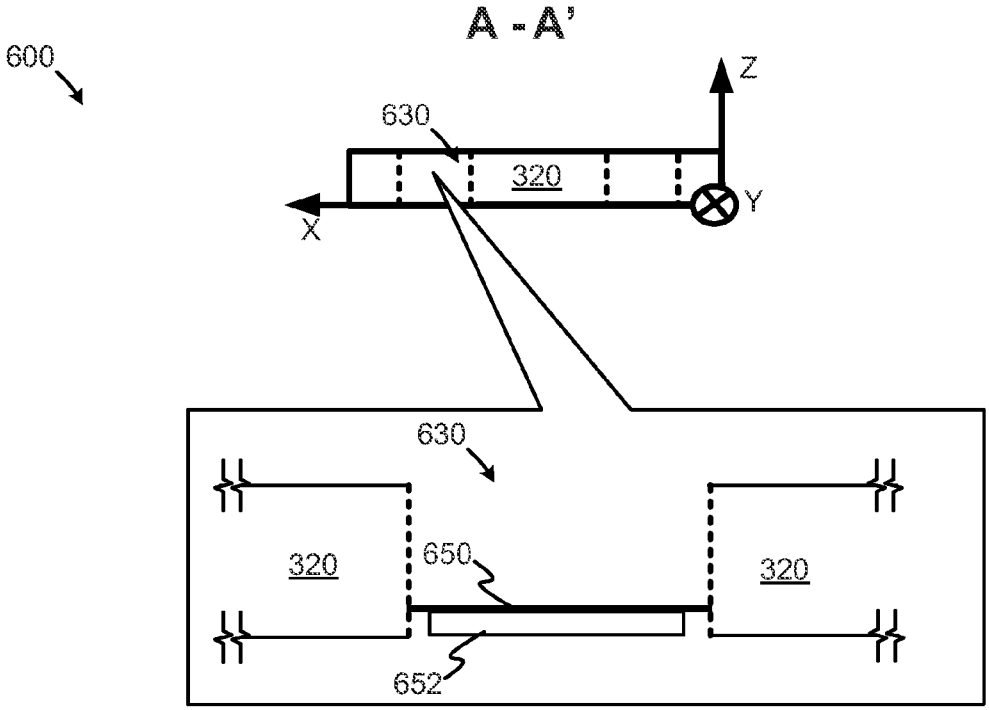
FIG. 6 is a cross-sectional view of a port of an audio source, according to some embodiments.
Figure 7:
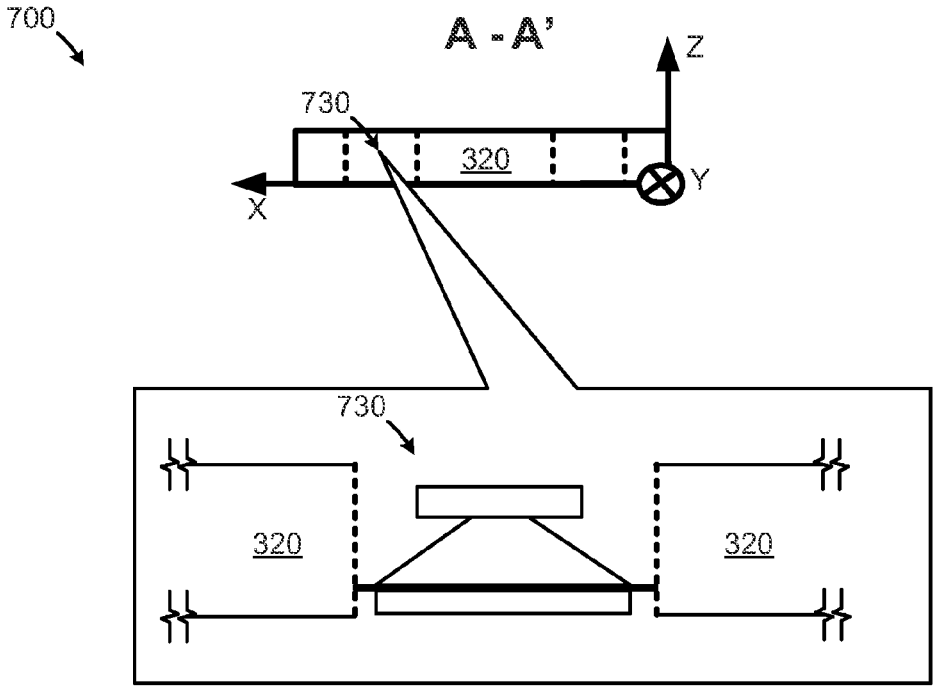
FIG. 7 is a cross-sectional view of another port of an audio source, according to some embodiments.

FIG. 5 is a top view of a bottom of an audio source, according to various embodiments. Diagram 500 is a top view of bottom 320 that includes one or more ports 530. Cross-sectional view A-A' of bottom 320 is depicted in FIGS. 6 and 7. One or more ports 530 can coincide with contact points on bottom surface 322*b* of bottom 320, as shown in FIG. 4. A contact point is a location at which an audio source contacts a user through which low frequency acoustic energy can be transferred to the user.

FIG. 6 is a cross-sectional view of a port of an audio source, according to some embodiments. Diagram 600 includes bottom 320 having a port 630. As shown, port 630 includes a membrane 650, which is a flexible membrane, coupled to a mass 652. The combined structure of membrane 650 and mass 652 constitute a passive transducer configured to receive audio energy from a cavity of the audio source, which, in turn, propagates into the body of a user.

FIG. 7 is a cross-sectional view of another port of an audio source, according to some embodiments. Diagram 700 includes bottom 320 having a port 730. As shown, port 730 includes an active transducer, which is configured to generate low frequency audio for propagation into the tissue of the user.

Figure 8:
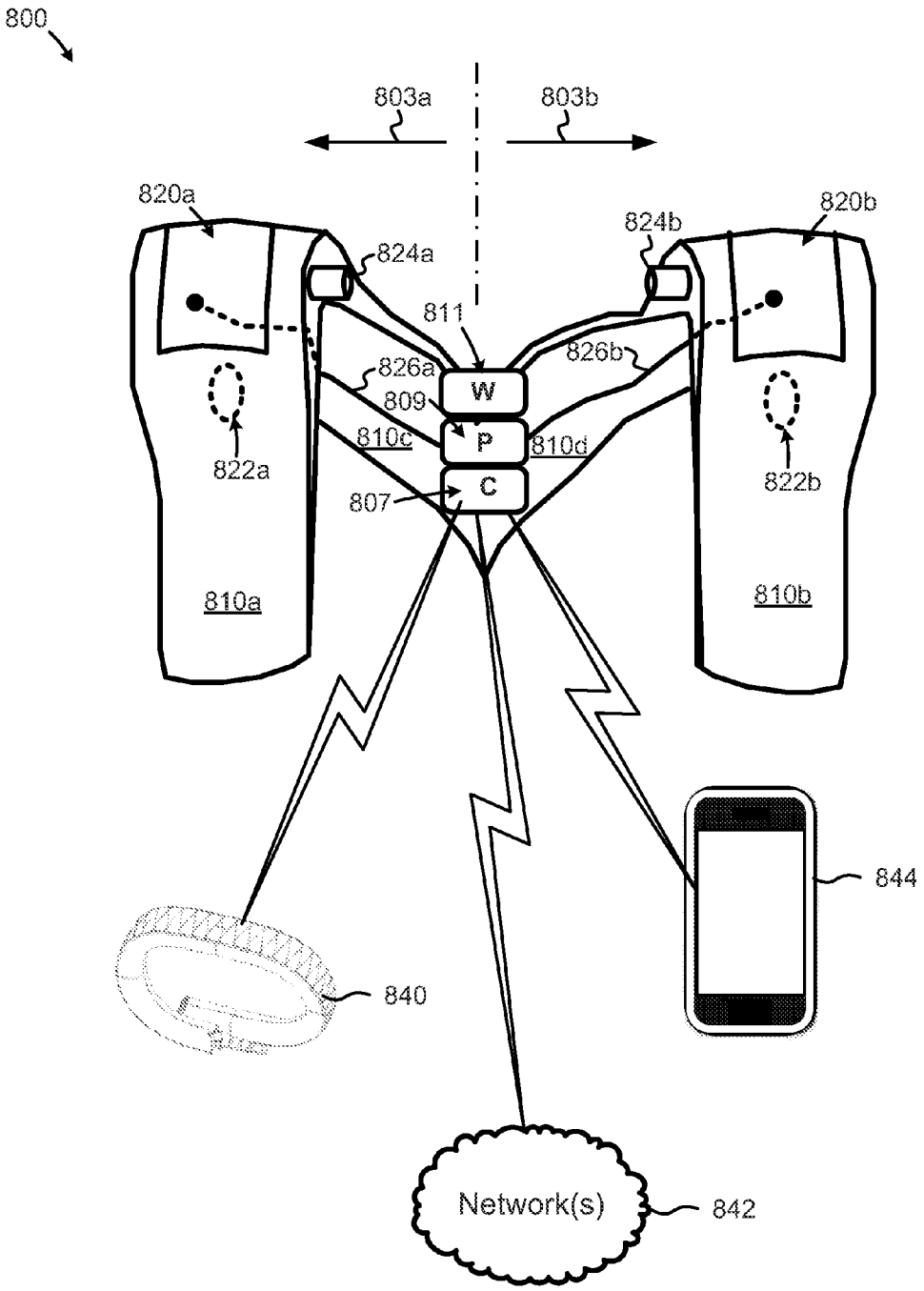
FIG. 8 is a diagram depicting an example of a personal audio and communication system, according to one embodiment.

FIG. 8 is a diagram depicting an example of a personal audio and communication system, according to one embodiment. As shown, the personal audio and communication system includes a first audio source 820*a* and a second audio source 820*b* disposed in a portion of an anterior support member 810*a* and in an anterior support member 810*b*B, respectively. The personal an audio indication system includes microphones 822*a* and 822*b*, which, while addicted as being disposed on or in respective anterior support members, the various embodiments are not so limited. Microphones 822*a* and 822*b* can be disposed anywhere in association with the personal audio and communication system. Microphones 822*a* and 822*b* can be configured to receive speech via the air. According to some embodiments, the personal audio and communication system of FIG. 8 can include skin surface microphones ("SSM") 824*a* and 824*b* for receiving acoustic energy, such as speech energy, from a user for transmission via a wireless network, for example. The personal audio and communication system also includes a power cell ("P") 809 for supplying the personal audio and communication system of power. In some examples, power cell 809 is a battery. Power and/or audio can be distributed via conductors 826*a* and 826*b*. The personal audio and communication system also includes a controller ("C") 807, which is configured to control one or more processes of the personal audio and communication system. In some cases, controller 807 can facilitate wireless communication with a wearable device 840, one or more networks 42, and a mobile computing device 844. As an example, the personal audio and communication system can implement any number of communications protocols including Bluetooth®, Wi-Fi, and the like. In a specific embodiment, when a user turns its head in the direction of 803*a* and produces speech, microphone 822*a* receives more acoustic energy than microphone 822*b*. Controller 807 detects the increased amount of the acoustic energy and determines that the user's head is turned the direction of 803*a*, and consequently, the ear that is associated with audio source 820*b* is displaced. As such, controller 807 can cause audio source 820*b*, in some examples, to modify the direction in which it propagates audio provide audio to the ear canal of the turned head. Also shown, is a wireless communication module ("W") 811 configured to facilitate wireless communication between at least the first and/or the second audio sources 1220*a* and 1220*b*, as well as a headset, a mobile device, a wearable device, and the like.

In some examples, a microphone (not shown) configured to contact (or to be positioned adjacent to) the skin of the wearer, whereby the microphone is adapted to receive sound and acoustic energy generated by the wearer (e.g., the source of sounds associated with physiological information). The microphone can also be disposed anywhere in the personal audio and communication device. According to some embodiments, the microphone can be implemented as a skin surface microphone ("SSM"), or a portion thereof, according to some embodiments. An SSM can be an acoustic microphone configured to enable it to respond to acoustic energy originating from human tissue rather than airborne acoustic sources. As such, an SSM facilitates relatively accurate detection of physiological signals through a medium for which the SSM can be adapted (e.g., relative to the acoustic impedance of human tissue). Examples of SSM structures in which piezoelectric sensors can be implemented (e.g., rather than a diaphragm) are described in U.S. patent application Ser. No. 11/199,856, filed on Aug. 8, 2005, and U.S. patent application Ser. No. 13/672,398, filed on Nov. 8, 2012, both of which are incorporated by reference. As used herein, the term human tissue can refer to, at least in some examples, as skin, muscle, blood, or other tissue. In some embodiments, a piezoelectric sensor can constitute an SSM. Data representing one or more sensor signals can include acoustic signal information received from an SSM or other microphone, according to some examples.

Figure 9:
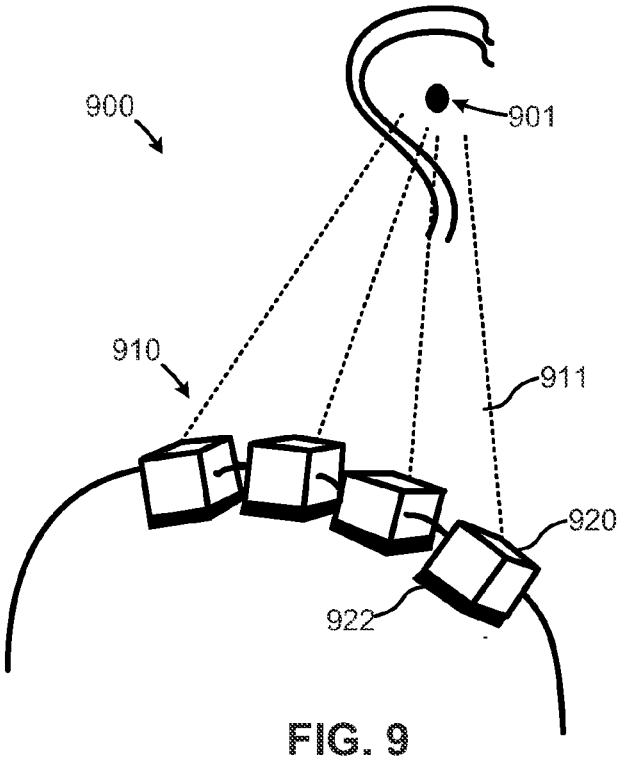
FIG. 9 is a diagram depicting an array of ultrasonic transducers as an audio source, according to some embodiments.

FIG. 9 is a diagram depicting an array of ultrasonic transducers as an audio source, according to some embodiments. In particular, diagram 900 depicts a group 910 of ultrasonic transducers 920, each of which is configured to generate a sound being the direction of 911 toward an ear canal 901. The multiple ultrasonic transmitters are used to produce audio above the range in which a human can hear. That is, the ultrasonic transducers can generate two or more ultrasonic signals that interfere with each other in the air at or near the ear canal 901 to create an audio signal.

Figure 10:
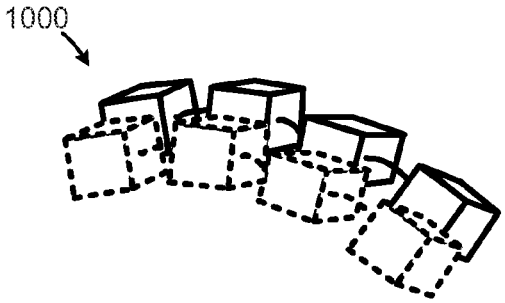
FIG. 10 is a diagram depicting an example of another array of ultrasonic transducers, according to some embodiments.

FIG. 10 is a diagram depicting an example of another array of ultrasonic transducers, according to some embodiments. As shown, group 1000 of ultrasonic transducers include of two arrayed rows of ultrasonic transducers, at least in this example.

Figure 11:
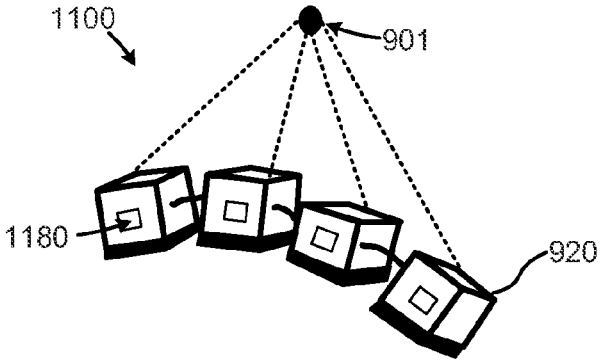
FIG. 11 depicts another example of an array of ultrasonic transducers, according to some embodiments.

FIG. 11 depicts another example of an array of ultrasonic transducers, according to some embodiments. Diagram 1100 includes a group of ultrasonic transducers 920 directed to create a sound at your canal 901. At least one ultrasonic transducer 920 includes an accelerometer 1180 configured to detect and orientation of the transducer relative to its intended direction of propagation, which is typically normal to the top surface of ultrasonic transducer 920 and in the direction to the corresponding ear. In some embodiments, the controller can detect an orientation of an ultrasonic transducer and modify the direction along which it transmits a directional audio signal.

FIGS. 12A to 14B depict various examples of other supporting members configured to support the positioning of directional speakers to facilitate personal audio, according to the various embodiments.

Figure 12A:
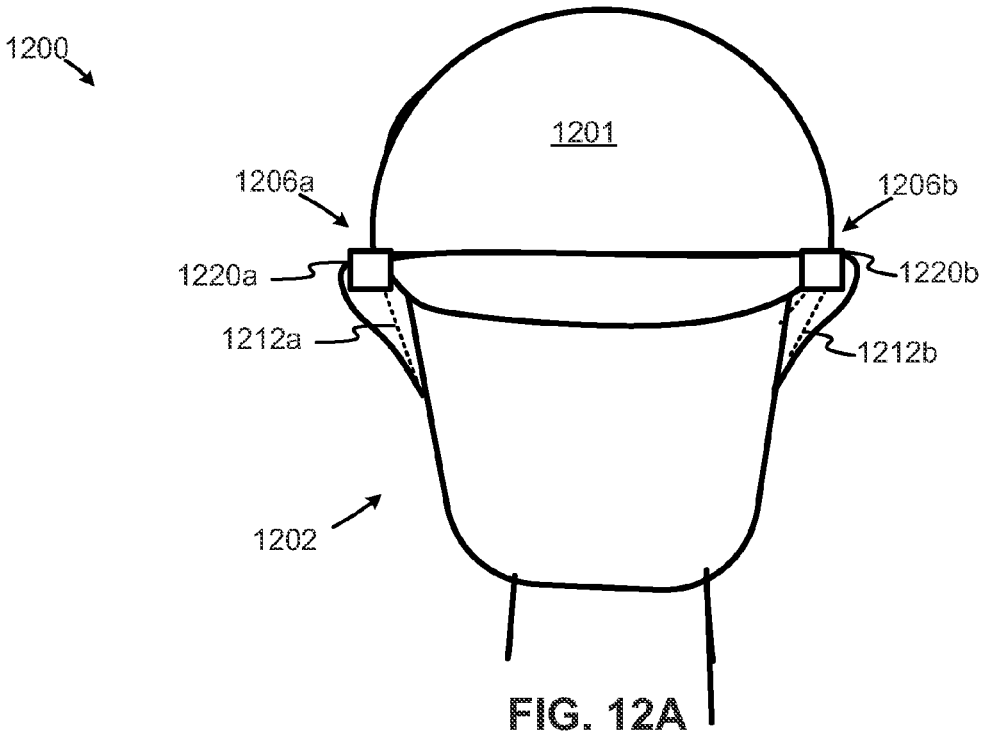
FIGS. 12A to 14B depict various examples of other supporting members configured to support the positioning of directional speakers to facilitate personal audio, according to the various embodiments.

FIG. 12A is a diagram depicting a front view of an implementation of audio sources, according to some embodiments. Diagram 1200 depicts audio sources 1220*a* and 1220*b* being configured to attach to any wearable items, such as a hat, eyewear, clothes, and the like. In FIG. 12A, a user 1202 is wearing a hat 1201 (or other head-related garment) onto which audio sources 1220*a* and 1220*b* are disposed. Audio sources 1220*a* and 1220*b* can include similar structures and/or functionalities as other examples audio sources described herein. First audio source 1220*a* includes a first directional speaker disposed in a first mounting region 1206*a* of hat 1201, whereas second audio source 1220*b* includes a second directional speaker disposed in a second mounting region 1206*b*. The first directional speaker of first audio source 1220*a* is configured to generate a directional sound beam 1212*a* directed to an ear and the second directional speaker of the second audio source 1220*b* is configured to generate a directional sound beam 1212*b* to another ear. In some embodiments each of audio sources 1220*a* and 1220*b* can include a wireless communication module (not shown) configured to communicate audio wirelessly to each other or to any other device, such as a headset, a mobile device, a wearable device, and the like. In this example, audio sources 1220*a* and 1220*b* of various embodiments enable personal listening experiences for a user 1202 (e.g., user 1202 receives only the audio in a non-occluded manner), whether the audio is uni-directional (e.g., user 1202 is listening to music) or bi-directional (e.g., user 1202 is receiving audio and transmitting audio (via a microphone in the personal audio and communication device) in a telephone call or a gaming environment).

Figure 12B:
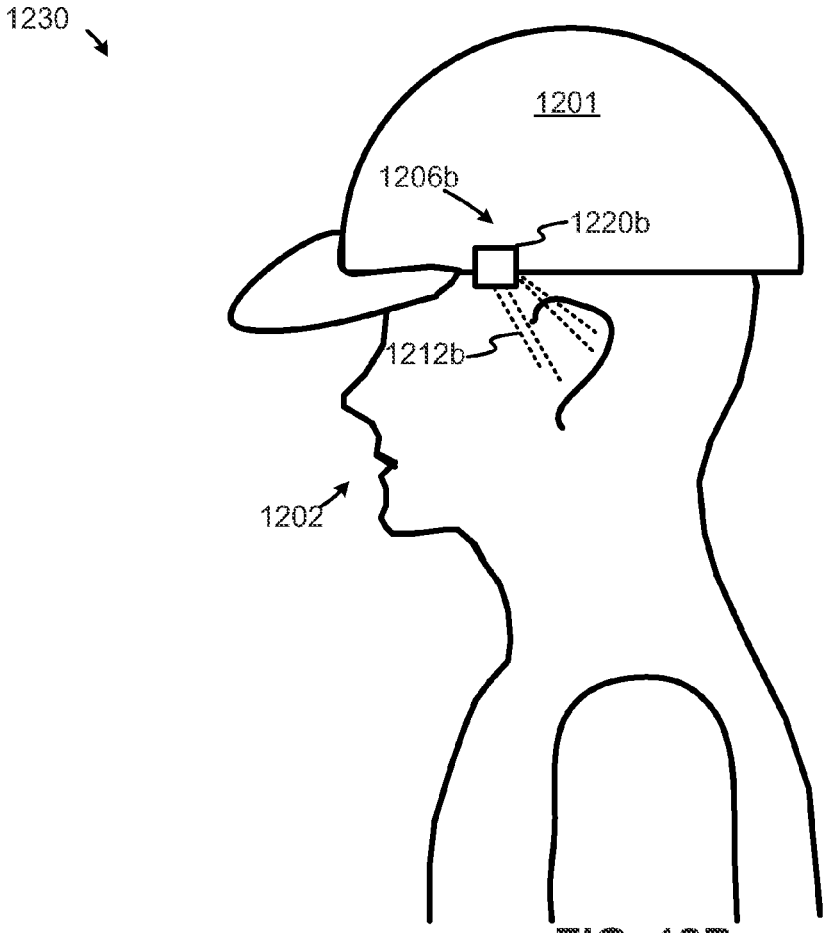

FIG. 12B is a diagram depicting a side view of audio sources, according to some embodiments. Diagram 1230 depicts a second audio source 1220*b* disposed at a mounting region 1206*b*. Second audio source 1220*b* is configured to generate a directional sound beam configured to propagate toward an ear canal. In some embodiments, second audio source 1220*b* can be disposed anywhere in mounting region 1206*b*, or anywhere on hat 1201.

Figure 13A:
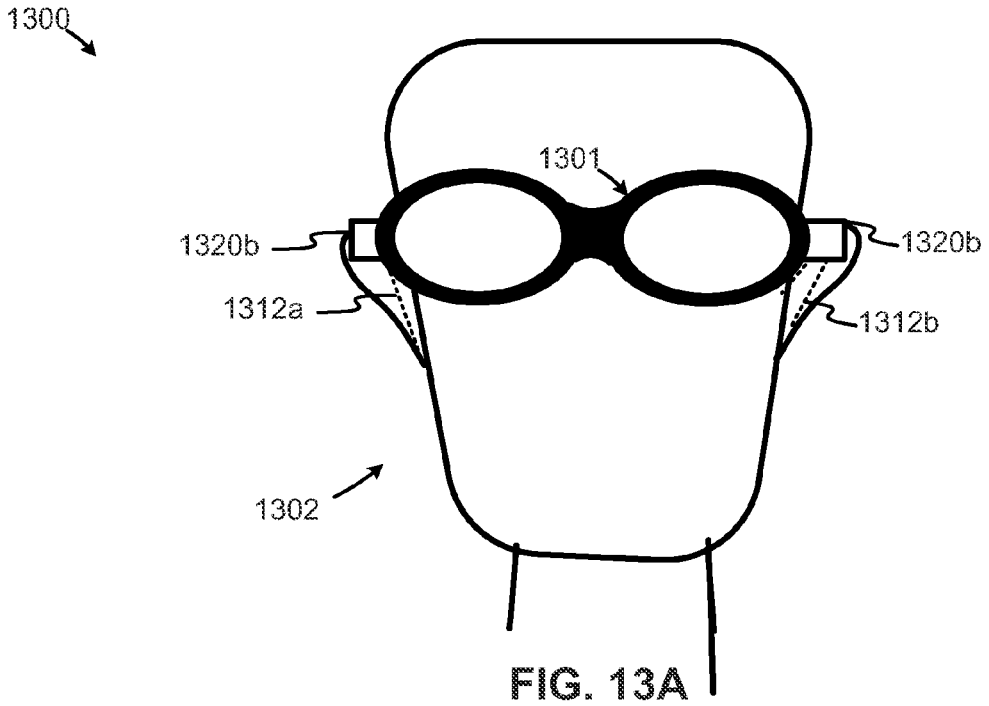

FIG. 13A is a diagram depicting a front view of an implementation of audio sources, according to some embodiments. Diagram 1300 depicts audio sources 1320*a* and 1320*b* being configured to attach to eyewear 1301. In FIG. 13A, a user 1302 is wearing eyewear 1301 (or other face/neck-related garment) onto which audio sources 1320*a* and 1320*b* can be disposed. Audio sources 1320*a* and 1320*b* can include similar structures and/or functionalities as other examples audio sources described herein. First audio source 1320*a* includes a first directional speaker disposed in a first mounting region of eyewear 1301, whereas second audio source 1320*b* includes a second directional speaker disposed in a second mounting region. The first directional speaker of first audio source 1320*a* is configured to generate a directional sound beam 1312*a* directed to an ear and the second directional speaker of the second audio source 1320*b* is configured to generate a directional sound beam 1312*b* to another ear. In some embodiments each of audio sources 1320*a* and 1320*b* can include a wireless communication module (not shown) configured to communicate audio wirelessly to each other or to any other device, such as a headset, a mobile device, a wearable device, and the like. In this example, audio sources 1320*a* and 1320*b* of various embodiments enable personal listening experiences for a user 1302 (e.g., user 1302 receives only the audio in a non-occluded manner), whether the audio is uni-directional (e.g., user 1302 is listening to music) or bi-directional (e.g., user 1302 is receiving audio and transmitting audio (via a microphone in the personal audio and communication device) in a telephone call or a gaming environment).

Figure 13B:
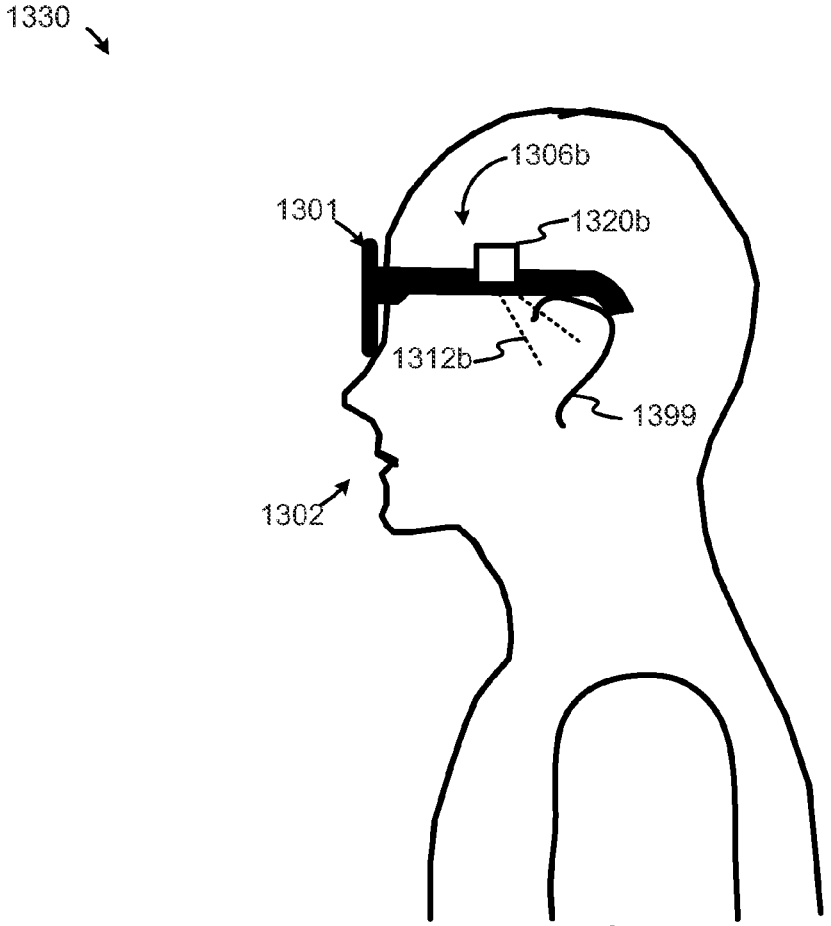

FIG. 13B is a diagram depicting a side view of audio sources, according to some embodiments. Diagram 1330 depicts a second audio source 1330*b* disposed at a mounting region 1306*b*. Second audio source 1320*b* is configured to generate a directional sound beam configured to propagate toward an ear canal of ear 1399. In some embodiments, second audio source 1320*b* can be disposed anywhere in mounting region 1306*b*, or anywhere on eyewear 1301. Note that low frequency functionality can be implemented to generate vibrations on the frame of eyewear 1301, which, in turn, is imparted upon the skin of user 1302.

Figure 14A:
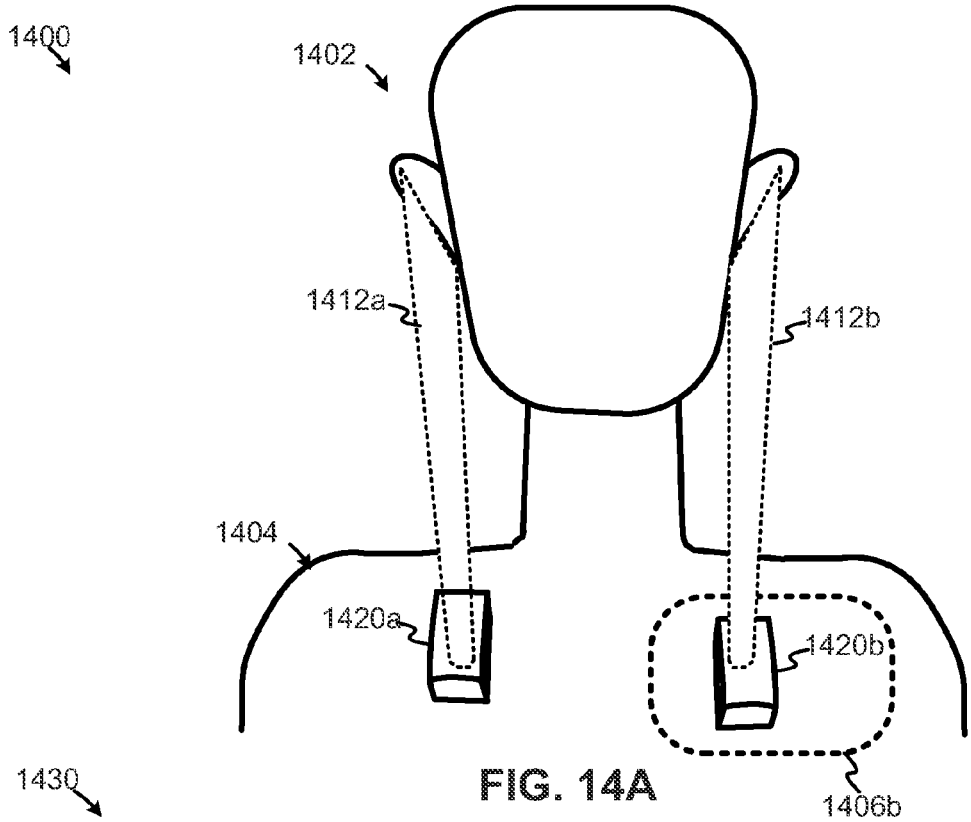

FIG. 14A is a diagram depicting a front view of an implementation of audio sources, according to some embodiments. Diagram 1400 depicts audio sources 1420*a* and 1420*b* being configured to integrate with or attach to (e.g., at an attachment point 1480) any garment or apparel, such as shirt 1404. In FIG. 14A, a user 1402 is wearing garment 1404 (or other body-worn garment) onto which audio sources 1420*a* and 1420*b* can be disposed and/or attached. Audio sources 1420*a* and 1420*b* can include similar structures and/or functionalities as other examples audio sources described herein. First audio source 1420*a* includes a first directional speaker disposed in a first mounting region of garment 1401, whereas second audio source 1420*b* includes a second directional speaker disposed in a second mounting region 1406*b*. The first directional speaker of first audio source 1420*a* is configured to generate a directional sound beam 1412*a* directed to an ear and the second directional speaker of the second audio source 1420*b* is configured to generate a directional sound beam 1412*b* to another ear. In some embodiments each of audio sources 1420*a* and 1420*b* can include a wireless communication module (not shown) configured to communicate audio wirelessly to each other or to any other device, such as a headset, a mobile device, a wearable device, and the like. In this example, audio sources 1420*a* and 1420*b* of various embodiments enable personal listening experiences for a user 1402 (e.g., user 1402 receives only the audio in a non-occluded manner), whether the audio is uni-directional (e.g., user 1402 is listening to music) or bi-directional (e.g., user 1402 is receiving audio and transmitting audio (via a microphone in the personal audio and communication device) in a telephone call or a gaming environment).

Figure 14B:
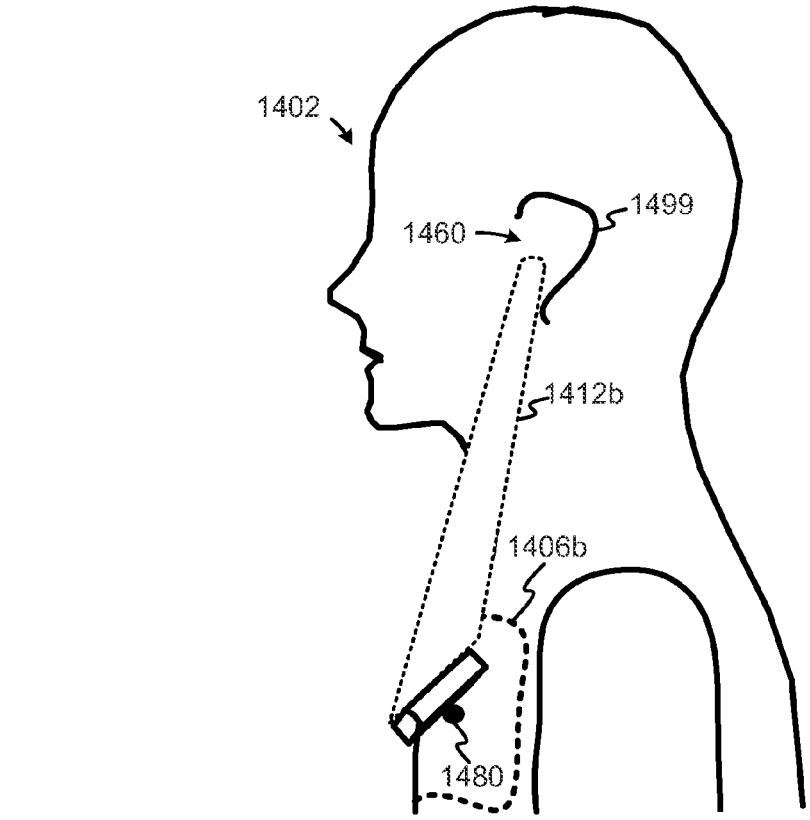

FIG. 14B is a diagram depicting a side view of audio sources, according to some embodiments. Diagram 1430 depicts a second audio source 1430*b* disposed at a mounting region on garment 1404. Second audio source 1420*b* is configured to generate a directional sound beam configured to propagate toward an ear canal 1460 of ear 1499. In some embodiments, second audio source 1420*b* can be disposed anywhere in mounting region 1406*b*, or anywhere on garment 1401.

Although the foregoing examples have been described in some detail for purposes of clarity of understanding, the above-described inventive techniques are not limited to the details provided. There are many alternative ways of implementing the above-described invention techniques. The disclosed examples are illustrative and not restrictive.

What is claimed:

1. An apparatus comprising:

a first audio source including a first directional speaker disposed at a first mounting region of a first support member, the first support member configured to position the first mounting region adjacent a first ear to substantially align the first directional speaker toward the first ear;

a second audio source including a second directional speaker disposed at a second mounting region of a second support member, the second support member configured to position the second mounting region adjacent a second ear to substantially align the second directional speaker toward the second ear;

a wireless communication module configured to communicate audio wirelessly at least to the first and the second audio sources;

a first surface including one or more ports configured to direct low frequency audio in another direction substantially opposite from a direction along which audio from the first directional speaker propagates; and a second surface including one or more ports configured to direct low frequency audio in another direction substantially opposite from a direction along which audio from the second directional speaker propagates.

2. An apparatus comprising:

a first audio source including a first directional speaker disposed at a first mounting region of a first support member, the first support member configured to position the first mounting region adjacent a first ear to substantially align the first directional speaker toward the first ear;

a second audio source including a second directional speaker disposed at a second mounting region of a second support member, the second support member configured to position the second mounting region adjacent a second ear to substantially align the second directional speaker toward the second ear;

a wireless communication module configured to communicate audio wirelessly at least to the first and the second audio sources;

a first surface including one or more ports configured to direct low frequency audio in another direction substantially opposite from a direction along which audio from the first directional speaker propagates; and a second surface including one or more ports configured to direct low frequency audio in another direction substantially opposite from a direction along which audio from the second directional speaker propagates, wherein at least a subset of the one or more ports of the first surface and the second surface are positioned in the first mounting region and the second mounting region, respectively, to direct the low frequency into a tissue of a user.

3. An apparatus comprising:

a first audio source including a first directional speaker disposed at a first mounting region of a first support member, the first support member configured to position the first mounting region adjacent a first ear to substantially align the first directional speaker toward the first ear;

a second audio source including a second directional speaker disposed at a second mounting region of a second support member, the second support member configured to position the second mounting region adjacent a second ear to substantially align the second directional speaker toward the second ear;

a wireless communication module configured to communicate audio wirelessly at least to the first and the second audio sources;

a first surface including one or more ports configured to direct low frequency audio in another direction substantially opposite from a direction along which audio from the first directional speaker propagates; and a second surface including one or more ports configured to direct low frequency audio in another direction substantially opposite from a direction along which audio from the second directional speaker propagates, wherein at least a subset of the one or more ports of the first surface and the second surface are positioned in the first mounting region and the second mounting region, respectively, to direct the low frequency into a tissue of a user, and wherein the tissue of the user comprises either predominantly bone or predominantly muscle, or both.

* * * * *